United States Patent [19]

Coppedge

[11] Patent Number: 4,825,586

[45] Date of Patent: May 2, 1989

[54] CHRISTMAS TREE STAND

[76] Inventor: Benjamin Coppedge, 25 Weatherstone Pkwy., Marietta, Ga. 30068

[21] Appl. No.: 197,526

[22] Filed: May 23, 1988

[51] Int. Cl.[4] ..... A01G 9/12

[52] U.S. Cl. ..... 47/40.5; 248/523; 248/529

[58] Field of Search ..... 47/40.5, 42, 43; 248/519, 523, 527, 524, 525, 526, 529; 24/303, 306, 486; 269/8; 411/393, 383

[56] References Cited

U.S. PATENT DOCUMENTS

| | | | |
|---|---|---|---|
| 2,014,896 | 9/1935 | Hollander | 248/525 |
| 2,537,826 | 1/1951 | Hauser | 248/524 |
| 2,615,660 | 10/1952 | Haumann | 47/40.5 |
| 2,905,414 | 9/1959 | Zierden | 47/40.5 |
| 2,913,202 | 11/1959 | Meldrum | 47/40.5 |
| 3,051,423 | 8/1962 | Wagner et al. | 47/40.5 |
| 3,058,707 | 10/1962 | Lego | 248/524 |
| 3,411,740 | 11/1968 | Schulz | 47/40.5 |
| 4,505,007 | 3/1985 | Aoki | 24/303 |

FOREIGN PATENT DOCUMENTS

| | | | |
|---|---|---|---|
| 0021479 | 10/1906 | Sweden | 47/40.5 |
| 0207536 | 2/1940 | Switzerland | 47/40.5 |
| 0374845 | 3/1964 | Switzerland | 24/303 |
| 0488751 | 8/1938 | United Kingdom | 47/40.5 |

OTHER PUBLICATIONS

Holiday Christmas Tree Stand (Box With Assembly Instructions).

*Primary Examiner*—Robert A. Hafer
*Assistant Examiner*—Jeffrey L. Thompson
*Attorney, Agent, or Firm*—Thomas & Kennedy

[57] ABSTRACT

A Christmas tree stand comprises a bowl, a support collar mounted over the bowl that bears a set of angularly spaced threaded nuts, and a set of turn screws threaded through the support collar nuts. A set of arcuate clamping plates is positioned in a cylindrical formation within the support collar. Each plate has a channel in which an end of one of the turn screws is rotatably captured. With this construction, threaded advancement of the turn screws may cause the arcuate clamping plates to tighten convergently upon a tree trunk positioned within the support collar without the arcuate plates rotating substantially out of their cylindrical formation.

7 Claims, 1 Drawing Sheet

CHRISTMAS TREE STAND

TECHNICAL FIELD

This invention relates to stands for use in supporting small trees indoors such as during the Christmas holidays.

BACKGROUND OF THE INVENTION

During the Christmas season it is traditional to display a small, decorated tree indoors. In the past cut trees were usually maintained vertically by nailing a set of wooden struts to their bottom. More recently prefabricated stands have been provided for this purpose. These stands typically have a cylindrical support ring or collar mounted above a bowl, both of which are supported by a set of legs. Turn screws are threaded through the sides of the support collar so that their ends may be driven against the side of a tree that is positioned within the collar upon the bowl to hold it in axial alignment with the collar and to hold it vertically once the stand is set upon a supporting floor. The bowl then provides means for holding a supply of water and nutrients so that the tree may be preserved in the indoor environment for a period of time.

A common problem associated with Christmas tree stands of the type just described has been the tendency for the ends of the turn screws to penetrate the tree. This not only may prevent a firm gripping engagement from being had but can also form cavities which can become enlarged and further lose good gripping engagement with the screws.

Previous attempts to rectify this problem have included the use of enlarged turn screw ends as illustrated in the stands shown in U.S. Pat. Nos. 2,014,896, 2,905,414 and 3,051,423. Serrated edges have also been provided to enhance gripping engagement as shown in the stand illustrated in U.S. Pat. No. 2,615,660. Leaf springs too have been used in various manners within the support collar as shown in U.S. Pat. Nos. 2,913,202 and 3,058,707.

The just described attempts at solving the problem have met with only limited effectiveness in firmly gripping trees so that they do not tend to tilt within the support collar. Accordingly, it is to the provision of a Christmas tree stand that overcomes the just described problem in a more effective manner that the present invention is primarily directed.

SUMMARY OF THE INVENTION

In one form of the invention a Christmas tree stand comprises a bowl and a support collar mounted over the bowl that bears a set of angularly spaced nuts. Turn screws are threadedly mounted through the support collar nuts. A set of arcuate clamping plates are positioned in a cylindrical formation within the support collar with each plate having a channel in which an end of one of the turn screws is rotatably captured. With this construction threaded advancement of the turn screws may cause the arcuate plates to tighten convergently upon a tree positioned within the support collar without the plates rotating out of their cylindrical formation.

In another form of the invention a Christmas tree stand comprises a support collar that has a plurality of threaded holes therethrough, and leg means mounted to the collar for supporting it above a floor. A plurality of turn screws are threaded through the support collar threaded holes. Partially cylindrical clamping plates are loosely mounted to an end of the turn screws so that the plates may be positioned flushly against the sides of a tree placed within the support collar in a cylindrical formation and mutually converged by threading of the turn screws without substantial change in the cylindrical formation of the plates against the side of the tree.

DETAILED DESCRIPTION

Figure 2:
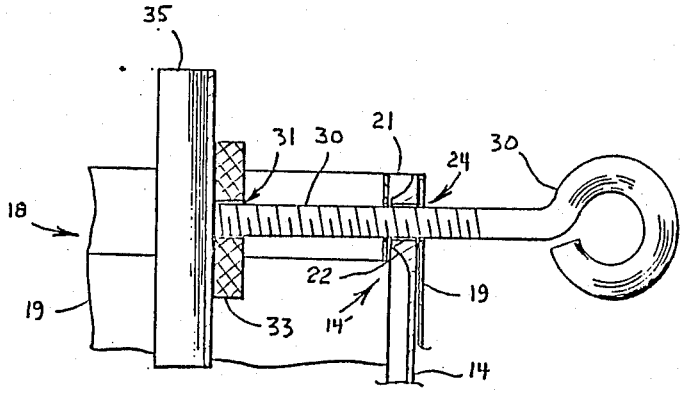
FIG. 2 is a side view, shown partly in cross-section, of a portion of the Christmas tree stand illustrated in FIG. 1.

With reference next to the drawing, there is shown a Christmas tree stand 10 that has a bowl or basin 12 with a circular lip 13 that is seated in arcuate grooves formed in the bottoms of four angularly spaced legs 14. The legs are contoured to terminate with flat feet 15 that lay in a plane slightly below the bottom 16 of the bowl 12 so that the legs support the bowl slightly above a supporting terrain, such as the floor of a home. The stand also includes a support collar or ring shown generally at 18 which has a cylindrical neck 19 that merges with an annular shoulder or spron 20. An end portion 14' of each leg is seated within the collar neck portion just beneath its top lip 21, as best shown in FIG. 2. The leg ends are formed with threaded nuts 22 that are aligned with four holes 24 formed in the collar neck. Alternatively, the nut may be a separate component or formed as a unitary part of the collar rather than as a unitary part of the leg. For purposes of this application however the nut is considered as forming a portion of the collar 18 since it is fixedly associated with it. Where it is formed on the leg, as shown here, it serves the dual function of providing means for securing the ends of the legs to the support collar as well as for use in providing thread support for turn screws, as hereafter described.

Figure 1:
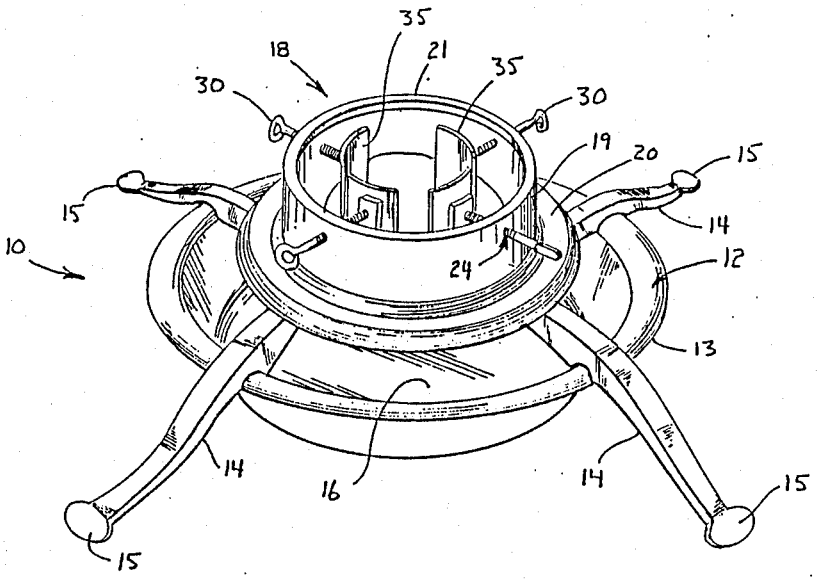
FIG. 1 is a perspective view of a Christmas tree stand that embodies principles of the invention in a preferred form.

With continued reference to the drawing, the Christmas tree stand is further seen to include four turn screws 30 which are threaded through the four nuts 22 mounted to the support collar 18. Each turn screw has an end portion 31 which is located within a hole or channel formed in a permanent magnet 33 that is fixedly secured as by adhesive to the outer surface of a partially cylindrically shaped clamping plate 35. Since the turn screws are formed of a magnetic material such as steel, their ends are attracted to the permanent magnets 33 and thus are captured within the channels by magnetic forces of attraction. At the same time, since the walls of the holes or channels within the magnet are smooth and unthreaded, the turn screws 30 may rotate freely within the holes of the permanent magnets without causing the magnets or clamping plates necessarily to turn in conjunction with rotary movement of the turn screws themselves. Thus, the magnet channels and magnetic screw ends effectively function as rotary joints. With the clamping plates 35 mounted to the ends of the four turn screws 30, and oriented as shown in FIG. 1, they assume a segmented, cylindrical formation within the bounds of the support collar 18.

To mount a Christmas tree to the stand the four clamping plates are drawn apart by rotation of the turn screws. The trunk of a cut tree is then passed down through the support collar and through the cylindrical formation of clamping plates, and its cut end set upon the bottom 16 of the bowl 12. The turn screws 30 are then rotated so as to cause the clamping plates to converge upon the sides of the tree trunk. Before actual engagement with the tree the plates may rotate to some degree in association with rotation of the turn screws due to friction. However, once the clamping plates have made contact with the tree trunk the resistance then offered by the tree serves to overcome any frictional force that tends to cause rotation of the turn screws to be accompanied by rotation of the permanent magnets and plates. Should any of the partially cylindrical support plates not be aligned coaxially with the support collar as illustrated in FIG. 1, and thus in general conformity to the shape of the tree trunk, they are then manually reoriented to such a formation. Further rotation of the turn screws then causes the clamping plates to converge into stronger gripping engagement with the tree until a very tight mounting is achieved. With the free rotary mounting of the plates to the ends of the turn screws, the snug, cylindrical formation is retained during the final tightening of the turn screws.

It thus is seen that a Christmas tree stand is now provided which overcomes problems long associated with those of the prior art. Though a permanent magnet is preferred in establishing a rotary joint between the turn screws and clamping plates, non-magnetic rotary joints may alternatively be utilized so long as the end of the turn screws are rotatably captured and loosely held to the clamping plates. Thus, it should be understood that though only one embodiment of the Christmas tree stand has been illustrated and discussed in detail, modifications, additions and deletions may be made thereto without departure from the spirit and scope of the invention as set forth in the following claims.

I claim:

1. A Christmas tree stand comprising a bowl, a support collar and a means supporting said support collar over said bowl, said support collar bearing a set of angularly spaced threaded nuts whereby the lower end portion of a cut tree trunk is inserted through said collar and into said bowl; a set of turn screws threaded through said support collar nuts and extending through the support collar toward the tree trunk; and a set of arcuate clamping plates positioned in a generally cylindrical formation within said support collar for surrounding the tree trunk with each plate having a channel in which an end of one of said turn screws is removably rotatably captured, wherein said turn screws are formed of magnetic material and wherein that portion of each of said clamping plates that defines said channel is a permanent magnet whereby threaded advancement of the turn screws causes the arcuate clamping plates to tighten convergently upon a tree trunk positioned within the support collar without the clamping plates rotating substantially out of their cylindrical formation.

2. The Christmas tree stand of claim 1 wherein each of said magnet channels has a generally smooth cylindrical wall.

3. The Christmas tree stand of claim 1 wherein each of said arcuate clamping plates has a partially cylindrical tree trunk engaging surface.

4. The Christmas tree stand of claim 1 further comprising a set of angularly spaced legs mounted to said bowl and to said support collar.

5. A Christmas tree stand comprising a support collar having a plurality of threaded holes therethrough; leg means mounted to said collar for supporting said collar above a floor or the like; a plurality of externally threaded turn screws positioned at spaced intervals about said support collar and each having an end portion threaded through said support collar threaded holes; a semi-cylindrical clamping plate removably mounted to an end of each of said turn screws, and magnet means rotatably retaining each of said clamping plates to said turn screw, whereby the partially cylindrical clamping plates may be positioned in a cylindrical formation flushly against the sides of a tree trunk placed within the support collar and mutually converged without substantial change in their cylindrical formation against the tree trunk sides by rotating the turn screws.

6. The Christmas tree stand of claim 4 wherein said magnet means comprises a permanent magnet rigidly mounted to each of said partially cylindrical clamping plates, and where each of said permanent magnets has a hole in a surface thereof in which said magnetic turn screw end is loosely positioned so that the turn screw may be freely rotated in the hole while remaining magnetically attracted to the magnet.

7. The Christmas tree stand of claim 5 further comprising a bowl mounted to said leg means adjacent said support collar.

* * * * *